US011220771B2

(12) United States Patent
Xu et al.

(10) Patent No.: US 11,220,771 B2
(45) Date of Patent: Jan. 11, 2022

(54) DRUM WASHING MACHINE

(71) Applicant: QINGDAO HAIER DRUM WASHING MACHINE CO., LTD., Shandong (CN)

(72) Inventors: Sheng Xu, Shandong (CN); Chunfeng Lao, Shandong (CN); Yanfen Lv, Shandong (CN); Yimin Li, Shandong (CN); Peishi Lv, Shandong (CN)

(73) Assignee: QINGDAO HAIER DRUM WASHING MACHINE CO., LTD., Shandong (CN)

( * ) Notice: Subject to any disclaimer, the term of this patent is extended or adjusted under 35 U.S.C. 154(b) by 144 days.

(21) Appl. No.: 16/612,185

(22) PCT Filed: May 8, 2018

(86) PCT No.: PCT/CN2018/086035
§ 371 (c)(1),
(2) Date: Nov. 8, 2019

(87) PCT Pub. No.: WO2018/205933
PCT Pub. Date: Nov. 15, 2018

(65) Prior Publication Data

US 2021/0131020 A1 May 6, 2021

(30) Foreign Application Priority Data

May 9, 2017 (CN) ..... 201710320246.0

(51) Int. Cl.
*D06F 39/14* (2006.01)
*D06F 23/02* (2006.01)
*D06F 39/08* (2006.01)

(52) U.S. Cl.
CPC ..... *D06F 23/025* (2013.01); *D06F 23/02* (2013.01); *D06F 39/088* (2013.01); *D06F 39/14* (2013.01)

(58) Field of Classification Search
CPC ..... D06F 39/083; D06F 39/088; D06F 39/14; D06F 23/02; D06F 37/22
(Continued)

(56) References Cited

U.S. PATENT DOCUMENTS 2,637,189 A 5/1953 Douglas
3,085,420 A 4/1963 Gosta
(Continued)

FOREIGN PATENT DOCUMENTS

CN 200955101 Y 10/2007
CN 104005201 A 8/2014
(Continued)

OTHER PUBLICATIONS

International Search Report (PCT/ISA/210) dated Aug. 10, 2018, by the Chinese Patent Office as the International Searching Authority for International Application No. PCT/CN2018/086035.
(Continued)

*Primary Examiner* — Tinsae B Ayalew
(74) *Attorney, Agent, or Firm* — Buchanan Ingersoll & Rooney PC

(57) ABSTRACT

A drum washing machine comprises a machine body, a door body, an inner drum and a water feeding device. The inner drum is rotatably arranged in the machine body, and holds water in a washing. A front part of the inner drum is provided with an input port for taking and putting clothes. The door body is mounted at a front part of the machine body corresponding to the input port of the inner drum for opening or closing the input port. An end with the input port of the inner drum is hermetically connected with the door body in
(Continued)

a relatively rotating manner. The water feeding device includes a first water feeding pipe connected with an external water source, a water collection sump corresponding to the first water feeding pipe arranged on the door body, and a second water feeding pipe arranged in the door body.

12 Claims, 3 Drawing Sheets

(58) Field of Classification Search
USPC ..... 68/12.14
See application file for complete search history.

(56) References Cited

U.S. PATENT DOCUMENTS

| | | | | |
|---|---|---|---|---|
| 3,595,036 | A | 7/1971 | Depas | |
| 2004/0231062 | A1* | 11/2004 | Sharrow | D06F 37/10 8/158 |
| 2007/0240456 | A1* | 10/2007 | Byun | D06F 39/02 68/17 R |
| 2015/0267156 | A1* | 9/2015 | Brooker | C11D 17/043 8/137 |

FOREIGN PATENT DOCUMENTS

| | | | | |
|---|---|---|---|---|
| CN | 104005203 | A | 8/2014 | |
| CN | 105696248 | A | 6/2016 | |
| CN | 205856868 | U | 1/2017 | |
| CN | 106436135 | A | 2/2017 | |
| DE | 19961462 | A1 | 6/2001 | |
| EP | 2484828 | B1 * | 8/2017 | D06F 39/083 |
| GB | 891285 | A | 3/1962 | |
| JP | 2007-186356 | A | 7/2007 | |
| JP | 2007-240456 | A | 9/2007 | |
| JP | 2010207462 | A | 9/2010 | |
| WO | 02/04734 | A1 | 1/2002 | |

OTHER PUBLICATIONS

Written Opinion (PCT/ISA/237) dated Aug. 10, 2018, by the Chinese Patent Office as the International Searching Authority for International Application No. PCT/CN2018/086035.
Office Action dated Jun. 15, 2021, by the Japanese Patent Office in corresponding Japanese Patent Application No. 2019-561856. (4 pages).
Extended European Search Report dated Mar. 13, 2020, issued by the European Patent Office in corresponding European Application No. 18797762.4. (4 pages).

* cited by examiner

DRUM WASHING MACHINE

TECHNICAL FIELD

The present disclosure relates to the technical field of clothes washing equipment, and more particularly relates to a drum washing machine.

BACKGROUND

In the prior art, a drum washing machine generally comprises an inner drum and an outer drum which are sleeved, the outer drum is sealed and used for containing water, and the inner drum is used for containing clothes and can rotate to beat and wash the clothes. Meanwhile, the inner drum is provided with draining holes, so that water in the outer drum flows into the inner drum through the draining holes to soak the clothes in the inner drum, the water in the inner drum flows out to the outer drum through the draining holes, and water in the clothes in the inner drum is discharged to the outer drum through the draining holes when the inner drum rotates at a high speed, so as to realize the purpose of washing clothes.

However, as the inner drum and the outer drum are mutually sleeved, dirt tends to be accumulated between the inner drum and the outer drum during the use of the washing machine. Besides, because the inner and outer drums are mutually sleeved, users cannot clean the outer wall of the inner drum and the inner wall of the outer drum, thus increasing bacteria in the washing machine and reducing the washing efficiency of the washing machine and the cleanliness of the washed clothes.

Meanwhile, in the existing washing machines, the inner drum is sleeved with the outer drum, the inner drum rotates to beat and wash clothes in the washing, so the washing capacity of the washing machine is based on the inner drum, resulting in a low utilization rate of the inner space of the washing machine, and the washing capacity of the washing machine cannot be expanded on the existing basis.

In view of this, the current research and development hotspot is to provide a washing machine to combine the inner and outer drum and make the inner drum be a sealed container, which can not only contain water and clothes, but also rotate to beat and wash the clothes. Meanwhile, since the washing machine is not provided with an outer drum or the outer drum and a housing of the washing machine are integrally arranged, the inner drum of the washing machine can be expanded to improve the washing capacity of the washing machine.

However, since the inner drum not only contains washing water, but also rotates to beat and wash clothes in the drum, how to design a feeding structure and/or draining structure suitable for the washing machine has become an urgent problem to be solved.

In view of the above technical defects, the present application is hereby submitted.

SUMMARY

In order to solve the above problem, the present disclosure provides a drum washing machine. Specifically, the following technical solution is adopted.

A drum washing machine includes a machine body, a door body, an inner drum and a water feeding device. The inner drum is rotatably arranged in the machine body, and the inner drum holds water in a washing. A front part of the inner drum is provided with an input port for taking and putting items. The door body is mounted at a front part of the machine body corresponding to the input port of the inner drum for opening or closing the input port. An end with the input port of the inner drum is hermetically connected with the door body in a relatively rotating manner.

The water feeding device includes a first water feeding pipe, a water collection sump and a second water feeding pipe; the first water feeding pipe is connected with an external water source, the water collection sump is arranged on the door body and corresponds to the first water feeding pipe, and the second water feeding pipe is arranged in the door body for communicating the water collection sump with the inside of the inner drum.

In some embodiment, the machine body is provided with an opening corresponding to the input port of the inner drum. The door body includes an outer door and an inner door. The inner door is rotatably mounted on the outer door. When the door body is closed, the outer door hermetically closes the opening in the machine body, and the inner door is hermetically connected with the inner drum. The water collection sump is arranged at a top of the outer door.

In some embodiment, the outer door includes an outer door cover covering the opening on the outside of the machine body, and an outer door body extending into the opening of the machine body. A side wall of the top of the outer door body is partially downwards sunken to form the water collection sump. An outlet end of the first water feeding pipe is located right above the water collection sump.

In some embodiment, an inner side of the outer door is connected with a shaft body through a vibration absorption device. The inner door is rotatably mounted on the shaft body through a bearing. The shaft body is internally hollow. One end of the second water feeding pipe is communicated with the water collection sump, and another end of the second water feeding pipe is communicated with the inner drum through the shaft body.

In some embodiment, the vibration absorption device includes a vibration absorption spring and a connection plate. One ends of a plurality of vibration absorption springs are mounted on the inner side of the outer door. Other ends of the vibration absorption springs are all connected with the connection plate, and the connection plate is fixedly connected with the shaft body.

A bearing pedestal is fixed on a center of an outer side of the inner door, and the bearing is mounted in the bearing pedestal and is in interference fit with the shaft body.

In some embodiment, a side wall of the outer door is connected with a side wall of the inner door through an elastic sealing sleeve. One end of the elastic sealing sleeve is hermetically and fixedly connected with the side wall of the outer door, and another end of the elastic sealing sleeve is kept in sealed contact with the side wall of the inner door.

A closed cavity is formed by the outer door, the elastic sealing sleeve and the inner door. The second water feeding pipe is arranged in the closed cavity.

In some embodiment, the water feeding device includes a water box. The first water feeding pipe is communicated with the water box through a connection hose, and the second water feeding pipe is communicated with the water collection sump through the connection hose.

In some embodiment, the drum washing machine further includes an outer drum. A front end of the outer drum is fixed on an inner wall of the machine body. The inner drum is rotatably arranged in the outer drum. A centrifugal valve is arranged on the side wall of the inner drum.

During the washing, the centrifugal valve is closed, water is held in the inner drum, and no water exists between the inner drum and the outer drum. During a dewatering, the centrifugal valve is opened, and washing water is drained to a space between the inner drum and the outer drum through the centrifugal valves and discharged by the outer drum.

In some embodiment, a diameter of an end with the input port of the inner drum is smaller than a diameter of an inner drum bottom. The side wall of the inner drum is inclined upwards from the end with the input port to the inner drum bottom. A plurality of centrifugal valves is arranged and is uniformly distributed along the circumference of the side wall, close to the inner drum bottom, of the inner drum.

In some embodiment, the drum washing machine further includes a center rotating shaft, a driving device and a supporting vibration absorption device. The inner drum is connected with the driving device through the center rotating shaft in a transmission way.

The supporting vibration absorption device includes a supporting frame, a vibration absorption hanging spring and a vibration absorber. One end of the supporting frame is sleeved on the center rotating shaft and is supportedly connected with the center rotating shaft through a bearing. Another end of the supporting frame extends to the outer periphery of the outer drum for mounting the hanging spring and the vibration absorber.

The inner drum of the drum washing machine of the present disclosure is a holeless drum without a dewatering hole in the inner drum wall. During the washing, the washing water is held in the drum, and the inner drum rotates to wash clothes. The drum washing machine of the present disclosure may not have an outer drum. In this way, the volume of the inner drum is increased without changing the size of the machine body, thus increasing the capacity of the drum washing machine. In addition, the inner drum holds the water, which solves the problem that the outer wall of the inner drum and the inner wall of the outer drum easily "hide dirt" over time because the washing water of the existing washing machine enters a space between the inner drum and the outer drum.

The drum washing machine realizes washing by lifting/beating clothes through rotation of the inner drum. The outer drum of the existing drum washing machine is mainly used for holding water. Since the outer drum is fixed, sealing is generally realized by the hermetical connection between the outer drum and the machine body. According to the drum washing machine of the present disclosure, the inner drum is creatively designed into the holeless drum. The inner drum is horizontally placed, so that the end with the input port of the inner drum in the present embodiment and the door body may be hermetically connected in the relatively rotating manner, which ensures the leakproofness of the inner drum, and realizes the water holding function of the inner drum. Meanwhile, the rotation of the inner drum is not affected to realize the washing and dewatering functions.

The inner drum of the drum washing machine of the present disclosure is simultaneously used as a drum for holding water and washing. Due to the rotation of the inner drum, the drum washing machine of the present disclosure further includes the water feeding device in order to realize water feeding of the inner drum. The water feeding device includes the first water feeding pipe connected with the external water source, the water collection sump arranged on the door body and corresponds to the first water feeding pipe, and the second water feeding pipe arranged in the door body and used for enabling the water collection sump to communicate with the inside of the drum.

The drum washing machine of the present disclosure realizes to feed water through the inside of the door body according to the characteristic of a hermetical connection structure of the door body and the inner drum. In addition, since the door body needs to be opened and closed for taking and putting items, it is necessary that the present disclosure feeds water through the door body without affecting the opening and closing of the door body. Therefore, the water collection sump opposite to the first water feeding pipe is arranged on the door body in the present disclosure. In this way, the fed water enters the water collection sump through the first water feeding pipe and enters to the inner drum through the second water feeding pipe. In the present disclosure, through the arrangement of the water collection sump on the door body, the fed water of the first water feeding pipe may be collected, thus realizing water feeding of the inner drum and not affecting the normal opening and closing of the door body at the same time.

Figure 1:
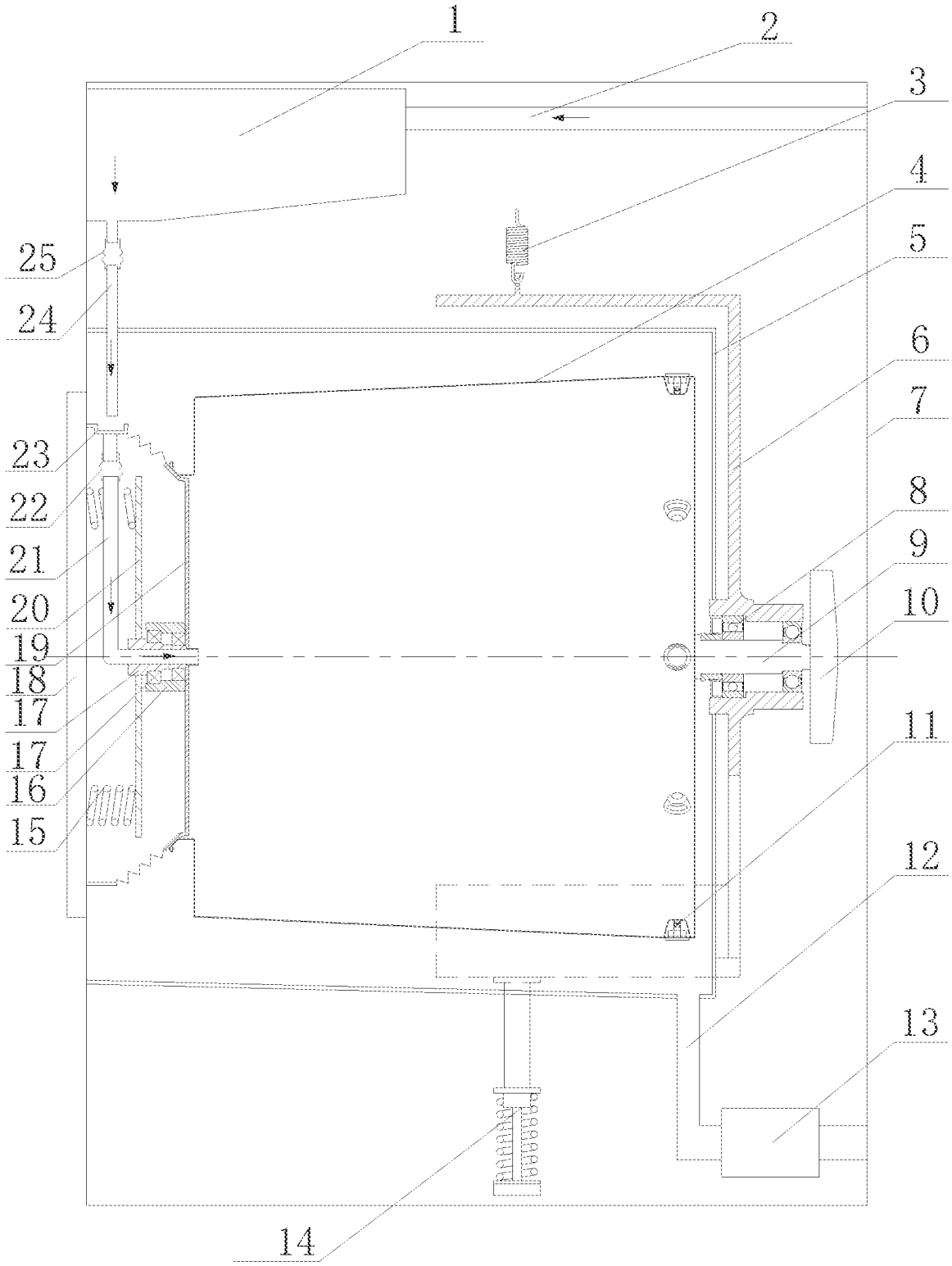
FIG. 1 is a front view of a drum washing machine of an embodiment of the present disclosure.
Figure 2:
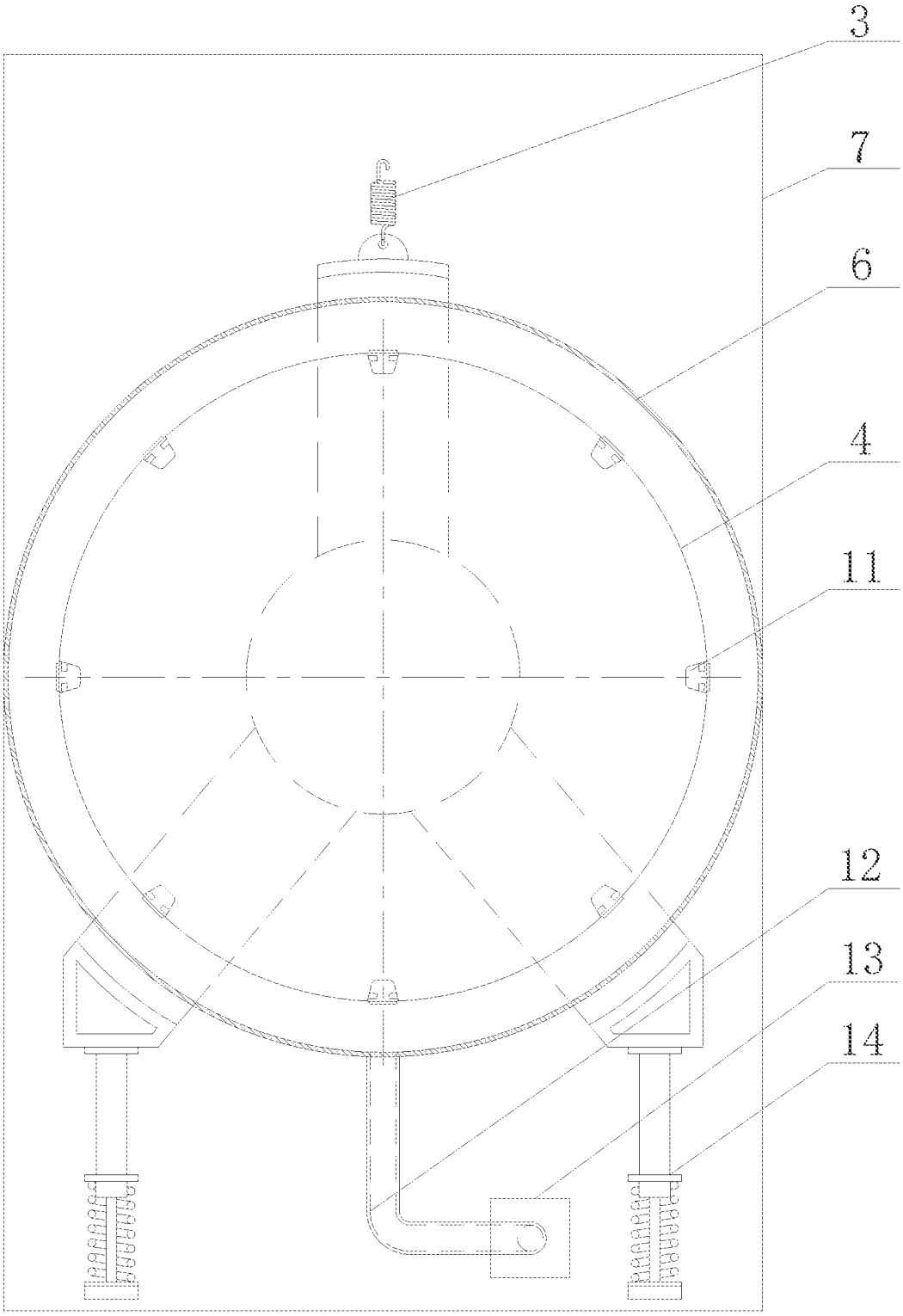
FIG. 2 is a left view of the drum washing machine of the embodiment of the present disclosure.

Numerals in the drawings: 1: water box; 2: third water feeding pipe; 3: vibration absorption hanging spring; 4: inner drum; 5: outer drum; 6: supporting frame; 7: machine body; 8: bearing; 9: center rotating shaft; 10: driving device; 11: centrifugal valve; 12: main drainage pipe; 13; drainage valve; 14: vibration absorber; 15: vibration absorption spring; 16: bearing pedestal; 17: shaft body; 18: outer door; 19: inner door; 20: connection plate; 21: second water feeding pipe; 22: second connection hose; 23: water collection sump; 24: first water feeding pipe; 25: first connection hose; 26: elastic sealing sleeve; and 27: bearing.

DETAILED DESCRIPTION

A drum washing machine of the present disclosure is described in detail below in conjunction with accompanying drawings.

As shown in FIG. 1, FIG. 2, FIG. 3 and FIG. 4, a drum washing machine of the present embodiment includes a machine body 7, a door body and an inner drum 4. The inner drum 4 is rotatably arranged in the machine body 7, and holds water in a washing. A front part of the inner drum 4 is provided with an input port for taking and putting items. The door body is mounted at a front part of the machine body 7 in an openable/closable manner, and corresponds to the input port of the inner drum 4. An end with the input port of the inner drum 4 is hermetically connected with the door body in a relatively rotating manner.

The inner drum 4 of the drum washing machine of the present embodiment is a holeless drum without a dewatering hole in the inner drum wall. During the washing, washing water is held in the inner drum 4, and the inner drum 4 rotates to wash clothes. The drum washing machine of the present disclosure may not have an outer drum. In this way, the volume of the inner drum 4 is increased without changing the size of the machine body, thus increasing the capacity of the drum washing machine. In addition, the inner drum 4 holds the water, which solves the problem that the outer wall of the inner drum and the inner wall of the outer drum easily "hide dirt" over time because the washing water of the existing washing machine enters a space between the inner drum and the outer drum.

The drum washing machine realizes washing by lifting/beating clothes through rotation of the inner drum 4. The outer drum of the existing drum washing machine is mainly used for holding water. Since the outer drum is fixed, sealing is generally realized by the hermetical connection between the outer drum and the machine body. According to the drum washing machine of the present disclosure, the inner drum 4 is creatively designed into the holeless drum. The inner drum 4 is horizontally placed, so that the end with the input port of the inner drum 4 of the present embodiment and the door body may be hermetically connected in the relatively rotating manner, which ensures the leakproofness of the inner drum 4, and realizes the water holding function of the inner drum 4. Meanwhile, the rotation of the inner drum 4 is not affected to realize the washing and dewatering functions.

The inner drum 4 of the drum washing machine of the present disclosure is simultaneously used as a drum for holding water and washing. Due to the rotation of the inner drum 4, the drum washing machine of the present disclosure further includes a water feeding device in order to realize water feeding of the inner drum 4. The water feeding device includes a first water feeding pipe 24 connected with an external water source, a water collection sump 23 arranged on the door body and corresponds to the first water feeding pipe 24, and a second water feeding pipe 21 arranged in the door body and used for enabling the water collection sump 23 to communicate with the inside of the inner drum 4.

The drum washing machine of the present disclosure realizes to feed water through the inside of the door body according to the characteristic of a hermetical connection structure of the door body and the inner drum 4. In addition, since the door body needs to be opened and closed for taking and putting items, it is necessary that the present disclosure feeds water through the door body without affecting the opening and closing of the door body. Therefore, the water collection sump 23 opposite to the first water feeding pipe 24 is arranged on the door body in the present disclosure. In this way, the fed water enters the water collection sump 23 through the first water feeding pipe 24 and enters the inner drum through the second water feeding pipe 21. In the present embodiment, through the arrangement of the water collection sump on the door body, the fed water of the first water feeding pipe 24 may be collected, thus realizing water feeding of the inner drum 4 and not affecting the normal opening and closing of the door body at the same time.

As a preferred implementation mode of the present embodiment, the machine body 7 is provided with an opening corresponding to the input port of the inner drum. The door body includes an outer door 18 and an inner door 19. The inner door 19 is rotatably mounted on the outer door 18. When the door body is closed, the outer door 18 hermetically closes the opening in the machine body, and the inner door 19 is hermetically connected with the inner drum 4. In this way, the rotatable hermetical connection of the inner drum 4 of the drum washing machine of the present embodiment relative to the door body may be realized.

Further, since the outer door 18 is fixed, the water collection sump 23 in the present embodiment is arranged at a top of the outer door 18.

Specifically, the outer door 18 in the present embodiment includes an outer door cover covering the opening on the outside of the machine body 7, and an outer door body extending into the opening of the machine body. The side wall of the top of the outer door body is partially downwards sunken to form the water collection sump 23. An outlet end of the first water feeding pipe 24 is located right above the water collection sump 23.

The drum washing machine may inevitably vibrate the inner drum 4 during working, and the inner drum 4 in the present embodiment is hermetically connected with the door body, so that in consideration of the vibration problem of the inner drum 4, the inner side of the outer door 18 in the present embodiment is connected with a shaft body 17 through a vibration absorption device, and the inner door 19 is rotatably mounted on the shaft body 17 through a bearing 27.

Specifically, the vibration absorption device in the present embodiment includes a vibration absorption spring 15 and a connection plate 20. A plurality of vibration absorption springs 15 are mounted on the inner side of the outer door 18. The other ends of the vibration absorption springs 15 are all connected with the connection plate 20, and the connection plate 20 is fixedly connected with the shaft body 17. A bearing pedestal 16 is fixed in the center of the outer side of the inner door 19, and the bearing 27 is mounted in the bearing pedestal 16 and is in interference fit with the shaft body 17.

Meanwhile, the shaft body 17 in the present embodiment is internally hollow. One end of the second water feeding pipe 21 is communicated with the water collection sump 23, and another end of the second water feeding pipe 21 is communicated with the inner drum 4 through the shaft body 17.

As a preferred implementation mode of the present embodiment, the side wall of the outer door 18 is connected with the side wall of the inner door 19 through an elastic sealing sleeve 26. One end of the elastic sealing sleeve 26 is hermetically and fixedly connected with the side wall of the outer door 18, and the other end of the elastic sealing sleeve 26 is kept in sealed contact with the side wall of the inner door 19. A closed cavity is defined by the outer door 18, the elastic sealing sleeve 26 and the inner door 19. The second water feeding pipe 21 is arranged in the closed cavity.

The components such as the vibration absorption device, the shaft body and the bearing in the present embodiment are all arranged in the sealed cavity, thus achieving higher leakproofness.

The water feeding device in the present embodiment further includes a water box 1. The first water feeding pipe 24 is communicated with the water box 1 through a first connection hose 25, and the second water feeding pipe 21 is communicated with the water collection sump 23 through a second connection hose 22.

The water box 1 in the present embodiment is connected with a third water feeding pipe 2. The third water feeding pipe 2 is connected with a water tap to guide water into the water box 1.

In order to realize drainage of the drum washing machine of the present embodiment, the drum washing machine of the present embodiment further includes an outer drum 5. A front end of the outer drum 5 is fixed on the inner wall of the machine body 7. The inner drum 4 is rotatably arranged in the outer drum 5. A centrifugal valve 11 is arranged on the side wall of the inner drum 4.

Figure 3:
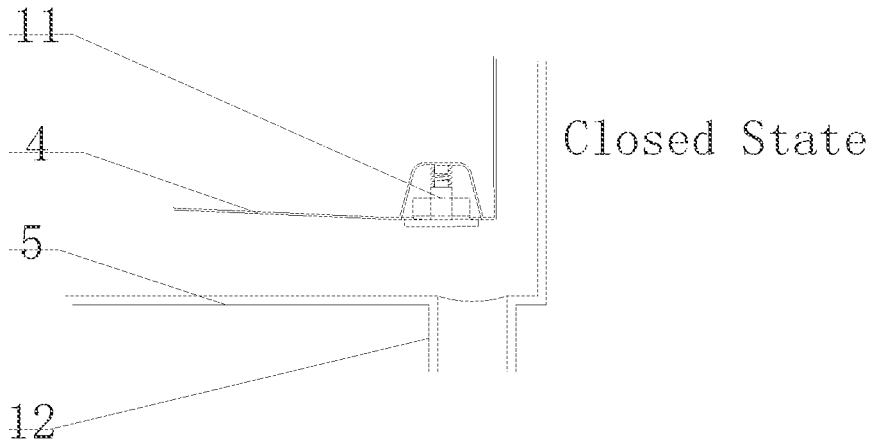
FIG. 3 is a schematic diagram of a centrifugal valve, in a closed state, of the drum washing machine of the embodiment of the present disclosure.
Figure 4:
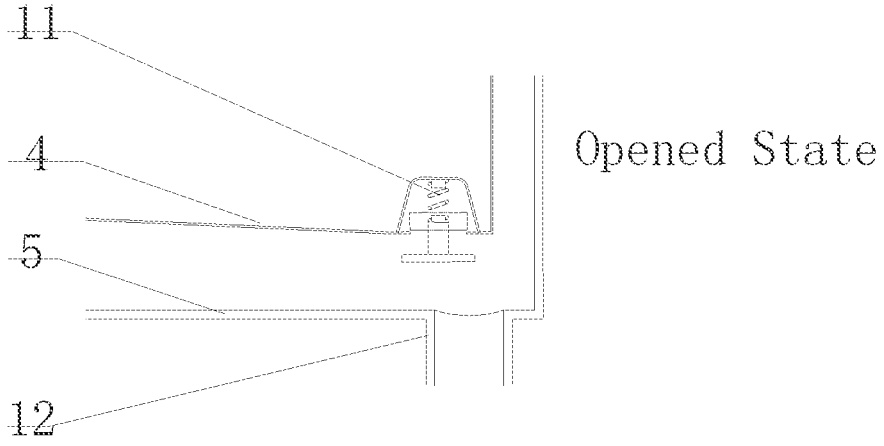
FIG. 4 is a schematic diagram of a centrifugal valve, in an opened state, of the drum washing machine of the embodiment of the present disclosure.

The centrifugal valve 11 in the present embodiment includes a valve plug and a spring. As shown in FIG. 3 and FIG. 4, the valve plug of the centrifugal valve is kept in a normally-closed state without a centrifugal force under the action of an elastic force of the spring. When the inner drum reaches a certain rotating speed, the centrifugal valve plug is automatically opened under the action of the centrifugal force, thus realizing the drainage.

The present embodiment makes use of the working principle of the centrifugal valve 11, and controls drainage by controlling the rotation of the inner drum 4.

Specifically, during the washing of the drum washing machine of the present embodiment, the centrifugal valve 11 is closed, water is held in the inner drum 4, and no water exists between the inner drum 4 and the outer drum 5. During the dewatering, the centrifugal valve 11 is opened, and washing water is drained through the centrifugal valve 11 to a space between the inner drum 4 and the outer drum 5 and discharged through the outer drum 5. Of course, the centrifugal valve 11 may also be opened to realize the drainage by controlling the high-speed rotation of the inner drum 4 in the washing.

As a preferred implementation mode of the present embodiment, the diameter of the input port end of the inner drum 4 is smaller than the diameter of an inner drum bottom. The side wall of the inner drum 4 is inclined upwards from the end with the input port to the inner drum bottom. A plurality of centrifugal valves 11 are arranged and are uniformly distributed along the circumference of the side wall, close to the inner drum bottom, of the inner drum. The structural design of the inner drum 4 and the distribution mode of the centrifugal valves 11 may be better favorable for the drainage of the washing water under the high-speed centrifugal action.

An outer drum drainage port is formed in positions, corresponding to the centrifugal valve, of the outer drum 5 of the present embodiment, and is connected with a main drainage pipe 12. The main drainage pipe 12 is connected with a drainage valve 13.

The front end of the outer drum 5 of the present embodiment is fixed on the inner wall of the machine body 7. In order to realize vibration absorption of the inner drum 4, the drum washing machine of the present embodiment further includes a center rotating shaft 9, a driving device 10 and a supporting vibration absorption device. The inner drum 4 is connected with the driving device 10 through the center rotating shaft 9 in a transmission way. The supporting vibration absorption device includes a supporting frame 6, a vibration absorption hanging spring 3 and a vibration absorber 14. One end of the supporting frame 6 is sleeved on the center rotating shaft 9 and is connected with the center rotating shaft 9 through a bearing in a supporting manner. Another end of the supporting frame 6 extends to the outer periphery of the outer drum 5 for mounting the hanging spring 3 and the vibration absorber 14.

The drum washing machine of the present embodiment may also solve the drainage problem through the following implementation mode. A specific solution is as follows.

The center rotating shaft 9 of the drum washing machine of the present embodiment is internally hollow to form a water flow passage for drainage. The implementation mode may cancel the centrifugal valve.

In the present embodiment, the water flow passage is arranged in the center rotating shaft 9, so that drained water of the washing machine may flow in and flow out through the water flow passage, and the rotation of the inner drum may not affect the water feeding and drainage.

As a preferred implementation mode of the present disclosure, one end of the center rotating shaft 9 extends out of the driving device 10. The end extending of the center rotating shaft 9 is rotatably mounted on a communicating piece through a bearing. A communicating channel is arranged in the communicating piece, and enables the water flow passage to communicate with the water feeding device/drainage device.

The present disclosure elaborates by taking drainage realized through the water flow passage in the center rotating shaft 9 as an example. The water flow passage in the center rotating shaft 9 in the present embodiment is communicated with the drainage device to realize the drainage function. Specifically, the drainage device in the present embodiment includes a drainage pipe and a self-sucking pump. A water inlet of the self-sucking pump is communicated with the water flow passage in the center rotating shaft through the drainage pipe.

Since the center rotating shaft 9 is located at the center position of the inner drum bottom of the inner drum 4, instead of the lowest position of the inner drum, in order to ensure that the washing water in the inner drum 4 is drained better, the inner wall of a rear inner drum bottom of the inner drum 4 is provided with a water collection device for collecting water in the dewatering and/or drainage, and the water collection device is communicated with the water flow passage. In the dewatering and/or drainage, the water collection device collects the water in the inner drum and drains the water under the suction action of the self-sucking pump.

Specifically, the water collection device of the present embodiment is provided with a water collection cavity and a water collection passage. The water collection cavity is arranged in the center of the inner wall of the rear inner drum bottom of the inner drum 4, and is communicated with the water flow passage in the center rotating shaft 9. The water collection passage is arranged on the inner wall of the rear inner drum bottom of the inner drum. One end of the water collection passage is communicated with the water collection cavity, and another end of the water collection passage extends towards the inner wall of the inner drum 4.

Preferably, a plurality of water collection passages are arranged and are uniformly distributed in the circumferential direction of the rear inner drum bottom of the inner drum 4, respectively.

In order to cooperate with the water collection device to collect water, the end, opposite to the rear inner drum bottom, on the inner drum 4 in the present embodiment acts as a front inner drum cover. The diameter of the front inner drum cover is smaller than the diameter of the rear inner drum bottom. The side wall of the inner drum 4 is upwards inclined from the front inner drum cover to the rear inner drum bottom.

In order to achieve a water collection effect of the water collection device, rotation of the inner drum 4 is also needed. When the inner drum 4 rotates, the washing water is gathered on the surface of the side wall of the inner drum 4 under the centrifugal action. Due to the inclined structure of the side wall, the washing water is gathered from the front inner drum cover to the rear inner drum bottom along the inclined side wall of the inner drum 4 and guided into the water collection cavity through the water collection passages arranged here.

Therefore, the drum washing machine of the present embodiment realizes water collection and drainage in the dewatering by the high-speed rotation of the inner drum 4. A drainage procedure may be added after the washing. The drainage is realized by accelerating the high-speed rotation of the inner drum 4.

As a preferred implementation mode of the present embodiment, the water collection device of the present embodiment includes a cover plate mounted on the inner wall of the rear inner drum bottom of the inner drum. The cover plate is internally provided with a closed cavity to form the water collection cavity and the water collection passages. Or, the cover plate is internally provided with a groove with an opening. The cover plate and the inner wall of the rear inner drum bottom of the inner drum are hermetically connected to close the groove to form the water collection cavity and the water collection passages.

As a preferred implementation mode of the present embodiment, a protruding structure protruding from the inner bottom of the inner drum is arranged on the upper surface of the water collection device. The protruding structure may lift washings during washing, so as to enhance a washing effect.

The above descriptions are only preferred embodiments of the present disclosure, but not intended to limit the present disclosure in any forms. Although the present disclosure is disclosed above by the preferred embodiments, the preferred embodiments are not intended to limit the present disclosure. Any person skilled in the art can make some changes by using the above-mentioned technical contents or modify the technical contents as equivalent embodiments of equivalent changes without departing from the scope of the technical solution of the present disclosure. Any simple alterations, equivalent changes and modifications that are made to the above embodiments according to the technical essence of the present disclosure without departing from the contents of the technical solution of the present disclosure shall all fall within the scope of the solution of the present disclosure.

The invention claimed is:

1. A drum washing machine, comprising:

a machine body;

a door body;

an inner drum; and a water feeding device, wherein the inner drum is rotatably arranged in the machine body, and the inner drum holds water during a washing, a front part of the inner drum is provided with an input port for taking out and putting in items, the door body is mounted at a front part of the machine body corresponding to the input port of the inner drum for opening or closing the input port, and an end with the input port of the inner drum is hermetically connected with the door body in a relatively rotating manner, the water feeding device includes a first water feeding pipe, a water collection sump and a second water feeding pipe, the first water feeding pipe is connected with an external water source, the water collection sump is arranged on the door body and corresponds to the first water feeding pipe, and the second water feeding pipe is arranged in the door body for communicating the water collection sump with an interior of the inner drum, wherein the machine body is provided with an opening corresponding to the input port of the inner drum, the door body includes an outer door and an inner door, the inner door is rotatably mounted on the outer door, when the door body is in a closed state, the outer door hermetically closes the opening in the machine body, and the inner door is hermetically connected with the inner drum, an inner side of the outer door is connected with a shaft body through a vibration absorption device, the inner door is rotatably mounted on the shaft body through a bearing, and the shaft body is internally hollow, one end of the second water feeding pipe communicates with the water collection sump, and another end of the second water feeding pipe communicates with the inner drum through the shaft body.

2. The drum washing machine according to claim 1, wherein the water collection sump is arranged at a top of the outer door.

3. The drum washing machine according to claim 1, wherein the outer door comprises an outer door cover covering the opening on the outside of the machine body, and an outer door body extending into the opening of the machine body, a side wall of the top of the outer door body is partially downwards sunken to form the water collection sump, and an outlet end of the first water feeding pipe is located above the water collection sump.

4. The drum washing machine according to claim 1, wherein the vibration absorption device comprises at least one vibration absorption spring and a connection plate, one end of each vibration absorption spring is mounted on an inner side of the outer door; another end of each vibration absorption spring is connected with the connection plate, and the connection plate is fixedly connected with the shaft body, a bearing pedestal is fixed on a center of an outer side of the inner door, and the bearing is mounted in the bearing pedestal and is in interference fit with the shaft body.

5. The drum washing machine according to claim 1, wherein a side wall of the outer door is connected with a side wall of the inner door through an elastic sealing sleeve, one end of the elastic sealing sleeve is hermetically and fixedly connected with the side wall of the outer door, and another end of the elastic sealing sleeve is kept in seal with the side wall of the inner door, and a closed cavity is formed by the outer door, the elastic sealing sleeve and the inner door; and the second water feeding pipe is arranged in the closed cavity.

6. The drum washing machine according to claim 1, wherein the water feeding device comprises:

a water box, the first water feeding pipe communicates with the water box through a first connection hose, and the second water feeding pipe communicates with the water collection sump through a second connection hose.

7. The drum washing machine according to claim 1, comprising:

an outer drum, wherein a front end of the outer drum is fixed on an inner wall of the machine body, the inner drum is rotatably arranged in the outer drum, and a centrifugal valve is arranged on the side wall of the inner drum, wherein during the washing, the centrifugal valve is configured to be closed, water is held in the inner drum, and no water exists between the inner drum and the outer drum, and during a dewatering, the centrifugal valve is configured to be opened, and washing water is drained to a space between the inner drum and the outer drum through the centrifugal valve and discharged by the outer drum.

8. The drum washing machine according to claim 7, wherein a diameter of the end with the input port of the inner drum is smaller than a diameter of an inner drum bottom, a side wall of the inner drum is inclined from the end with the input port to the inner drum bottom in a direction away from a central axis of the inner drum, and a plurality of centrifugal valves are arranged and are uniformly distributed along a circumference of the side wall, close to the inner drum bottom of the inner drum.

9. The drum washing machine according to claim 7, comprising:

a center rotating shaft;

a driving device; and a supporting vibration absorption device, wherein the inner drum is connected with the driving device through the center rotating shaft in a transmission way, the supporting vibration absorption device comprises includes:

a supporting frame;

a vibration absorption hanging spring; and a vibration absorber, wherein one end of the supporting frame is sleeved on the center rotating shaft and is connected with the center rotating shaft through a bearing, and another end of the supporting frame extends to an outer periphery of the outer drum for mounting the hanging spring and the vibration absorber.

10. The drum washing machine according to claim 3, wherein a side wall of the outer door is connected with a side wall of the inner door through an elastic sealing sleeve, one end of the elastic sealing sleeve is hermetically and fixedly connected with the side wall of the outer door, and another end of the elastic sealing sleeve is kept in sealed with the side wall of the inner door, and a closed cavity is formed by the outer door, the elastic sealing sleeve and the inner door; and the second water feeding pipe is arranged in the closed cavity.

11. The drum washing machine according to claim 4, wherein a side wall of the outer door is connected with a side wall of the inner door through an elastic sealing sleeve, one end of the elastic sealing sleeve is hermetically and fixedly connected with the side wall of the outer door, and another end of the elastic sealing sleeve is kept in sealed with the side wall of the inner door, and a closed cavity is formed by the outer door, the elastic sealing sleeve and the inner door; and the second water feeding pipe is arranged in the closed cavity.

12. The drum washing machine according to claim 8, comprising:

a center rotating shaft;

a driving device; and a supporting vibration absorption device, wherein the inner drum is connected with the driving device through the center rotating shaft in a transmission way, the supporting vibration absorption device includes:

a supporting frame;

a vibration absorption hanging spring, and a vibration absorber, wherein one end of the supporting frame is sleeved on the center rotating shaft and is connected with the center rotating shaft through a bearing, and another end of the supporting frame extends to an outer periphery of the outer drum for mounting the hanging spring and the vibration absorber.

* * * * *